US009121354B2

(12) United States Patent
Kirbach et al.

(10) Patent No.: US 9,121,354 B2
(45) Date of Patent: Sep. 1, 2015

(54) MOUNTING OF A CAMSHAFT

(75) Inventors: Lutz Kirbach, Herzogenaurach (DE); Stefan Kieninger, Herzogenaurach (DE); Thomas Binder, Feldkirch (AT); Guido Scherzinger, Sax (CH); Markus Niederlechner, Schaanwald (LI)

(73) Assignees: Schaeffler Technologies AG & Co. KG, Herzogenaurch (DE); Thyssenkrupp Presta TecCenter AG, Eschen (LI)

( * ) Notice: Subject to any disclaimer, the term of this patent is extended or adjusted under 35 U.S.C. 154(b) by 0 days.

(21) Appl. No.: 14/124,739

(22) PCT Filed: May 16, 2012

(86) PCT No.: PCT/EP2012/002096

§ 371 (c)(1),
(2), (4) Date: Dec. 9, 2013

(87) PCT Pub. No.: WO2012/167867

PCT Pub. Date: Dec. 13, 2012

(65) Prior Publication Data

US 2014/0109851 A1 Apr. 24, 2014

(30) Foreign Application Priority Data

Jun. 8, 2011 (DE) ..... 10 2011 103 544

(51) Int. Cl.
*F01L 1/34* (2006.01)
*F02D 13/02* (2006.01)
(Continued)

(52) U.S. Cl.
CPC ..... *F02D 13/02* (2013.01); *F01L 1/053* (2013.01); *F01L 13/0036* (2013.01); *Y10T 29/49293* (2015.01)

(58) Field of Classification Search
CPC ..... F01L 1/053; F01L 13/0036; F02D 13/02; Y10T 29/49293
USPC ..... 123/90.15–90.18; 29/888.1
See application file for complete search history.

(56) References Cited

U.S. PATENT DOCUMENTS 4,882,825 A * 11/1989 Nakamura ..... 29/888.1
2005/0011480 A1 1/2005 Schultz et al.
(Continued)

FOREIGN PATENT DOCUMENTS

DE 10148177 4/2003
DE 10148179 4/2003
(Continued)

*Primary Examiner* — Zelalem Eshete
(74) *Attorney, Agent, or Firm* — Volpe and Koenig, P.C.

(57) ABSTRACT

Reciprocating-piston internal combustion engine having a crank mechanism, with at least one cylinder head, the intake and exhaust ducts of which are controlled by in each case at least one gas exchange valve which is configured as an intake or exhaust valve, which gas exchange valves can be actuated by cams of at least one camshaft and by transmission elements which are driven by said cams, wherein the cams are configured as sliding cams with at least two cams per sliding cam unit, which sliding cams are arranged via internal splining on an externally splined basic shaft such that they are fixed so as to rotate with it but can be displaced axially, at least one device which is fixed to the internal combustion engine for displacing the sliding cam unit into different axial positions via displacement grooves on the circumference of the sliding cam unit which interact with an actuator pin, and bearings for fixing the camshaft radially and axially on a component of the internal combustion engine, wherein the basic shaft is guided by bearings on the component of the internal combustion engine.

5 Claims, 2 Drawing Sheets

(51) Int. Cl.
*F01L 1/053* (2006.01)
*F01L 13/00* (2006.01)

(56) References Cited

U.S. PATENT DOCUMENTS

| | | | | |
|---|---|---|---|---|
| 2006/0169234 | A1* | 8/2006 | Kimura et al. | 123/90.16 |
| 2007/0034184 | A1 | 2/2007 | Dengler | |
| 2007/0178731 | A1 | 8/2007 | Elendt | |
| 2009/0229546 | A1* | 9/2009 | Clever et al. | 123/90.6 |
| 2009/0229550 | A1* | 9/2009 | Clever et al. | 123/90.17 |
| 2010/0176652 | A1 | 7/2010 | Arakawa | |
| 2010/0199934 | A1 | 8/2010 | Meintschel et al. | |
| 2010/0269769 | A1 | 10/2010 | Schoeneberg et al. | |
| 2011/0180027 | A1 | 7/2011 | Hartlieb et al. | |
| 2011/0185995 | A1* | 8/2011 | Deblaize et al. | 123/90.18 |
| 2012/0006292 | A1* | 1/2012 | Elendt et al. | 123/90.18 |
| 2012/0079913 | A1 | 4/2012 | Dollinger et al. | |
| 2012/0204824 | A1* | 8/2012 | Kamichika | 123/90.15 |

FOREIGN PATENT DOCUMENTS

| | | | |
|---|---|---|---|
| DE | 10148243 | | 4/2003 |
| DE | 102004002301 | | 8/2005 |
| DE | 102007010148 | | 9/2008 |
| DE | 102007010149 | | 9/2008 |
| DE | 102007010150 | | 9/2008 |
| DE | 102007016209 | | 10/2008 |
| DE | 102007027979 | | 1/2009 |
| DE | 102007027979 | A1 * | 1/2009 |
| DE | 102007037745 | | 2/2009 |
| DE | 102008028513 | | 12/2009 |
| DE | 102008060166 | | 6/2010 |
| DE | 102009007819 | | 8/2010 |
| DE | 102009030373 | | 12/2010 |
| DE | 102009022657 | | 1/2011 |
| DE | 102011001711 | A1 * | 10/2012 |
| EP | 1503048 | | 2/2005 |
| WO | 2004083611 | | 9/2004 |
| WO | 2005080761 | | 9/2005 |
| WO | 2006012959 | | 2/2006 |
| WO | 2010142408 | | 12/2010 |
| WO | WO 2010149454 | A1 * | 12/2010 |

* cited by examiner

MOUNTING OF A CAMSHAFT

FIELD OF THE INVENTION

A reciprocating-piston internal combustion engine having a crank mechanism, having at least one cylinder head, the intake and exhaust ducts of which are controlled by in each case at least one gas exchange valve designed respectively as an intake and an exhaust valve, which gas exchange valves can be actuated by cams on at least one camshaft and by transmission elements driven by said cams, wherein the cams are designed as sliding cams with at least two cams per sliding cam unit, which sliding cams are arranged using internal splines on an externally splined base shaft so as to prevent relative rotation but to allow axial movement, having at least one device which is fixed with respect to the internal combustion engine for moving the sliding cam unit into different axial positions via sliding grooves on the circumference of the sliding cam unit which interact with an actuator pin, and having bearings for fixing the camshaft radially and axially on a component of the internal combustion engine.

BACKGROUND

A camshaft for installation in a reciprocating-piston internal combustion engine of this kind is known from DE 101 48 243 A1. In the case of this camshaft, the sliding cam units have, on the outer circumference thereof, bearing locations which are guided in sliding bearings supported on the internal combustion engine. Here, the width of the bearing location corresponds to the width of the sliding bearing plus the travel of the sliding cam unit in the axial direction. Overall, therefore, the sliding bearing requires that the camshaft should have a large extent in the axial direction, as a result of which a large installation space is required, and this is felt to be disadvantageous. Moreover, as a result the base shaft of the camshaft is guided only indirectly in the radial direction by means of the internal and external splines of the sliding cam units and of the base shaft. This is also regarded as not being the optimum since the base shaft of the camshaft, which is connected on the input side to the crank mechanism of the reciprocating-piston internal combustion engine, is not guided with sufficient accuracy.

SUMMARY

It is therefore the object of the invention to improve the mounting of the camshaft of a reciprocating-piston internal combustion engine in such a way that the disadvantages described are eliminated, and accurate mounting of the camshaft is accomplished. Moreover, the mounting should be independent of the type of bearing. At the same time, low-cost production by simple means should also be accomplished.

The object of the invention is achieved by virtue of the fact that the base shaft is guided by bearings on the component of the internal combustion engine. Overall, accurate mounting of the base shaft and also of the camshaft is thereby obtained, and the width of the bearings also has only to be embodied to match the bearing parameters. The bearings can then be mounted on a smooth, circular-cylindrical bearing location which is made smaller or larger in diameter than the external splines. The bearings are arranged on the base shaft at locations which are not used by the sliding cam units. Here, the bearing locations serve as supports for sliding bearings or, alternatively, for rolling bearings. If appropriate, the bearing housings must then be of split design.

As a development of the invention, it is proposed that rings designed as supporting elements for bearings are secured on the base shaft. What is achieved by the rings is that the outside diameter thereof is larger than the external splines, ensuring that the bearing locations are easily accessible axially. The rings can also be embodied as split rings and be secured, e.g. clamped, on the base shaft. Here, the rings are connected directly to the base shaft, thus ensuring accurate guidance of the base shaft. Since the base shaft is fixed axially, the rings need only have the desired bearing width.

It is advantageous if the base shaft has continuous external splines including the regions of the sliding cam units and of the rings. The splines can thus be produced along the base shaft at low cost. The rings are then secured on the external splines of the base shaft. Here, the external splines of the base shaft can be embodied, for example, as straight-sided spline profiles or as splined hub profiles with involute splines or, alternatively, as polygonal profiles. On the inside, the rings can either be smoothly circular-cylindrical or, alternatively, designed to match the respective profile, wherein the rings are preferably secured by a nonpositive joint, wherein an interference fit is provided, in particular. However, the rings can also be fixed positively on the base shaft, wherein this can be accomplished by split lock washers, for example.

Particularly in the case of straight-sided spline profiles which have well-defined addendum surfaces and dedendum surfaces with radially aligned spline flanks, the use of a ring with a circular-cylindrical inner circumferential surface is recommended. However, the inner surfaces of the rings can also replicate the straight-sided spline profile, wherein the inner surfaces of the profile can be supported on the rings at the addendum and/or dedendum surfaces. In the case of support on the dedendum surfaces, it is not necessary to use all the surfaces. It may be sufficient for the inner surfaces to be supported on three dedendum surfaces distributed over the circumference, for example.

If the outer profile of the base shaft is designed as a splined hub profile with involute splines, it is also possible, as an alternative, for the rings to have matching internal splines with trapezoidal flanks, wherein the involutes of the splined hub profile and the trapezoidal flanks of the internal splines of the rings are designed to match one another in such a way that a nonpositive joint can be produced.

The rings described above are suitable, in particular, as inner rings of rolling bearings, in particular needle bearings. This gives a space-saving low-cost bearing design, wherein no separate oil supply with oil ducts is required for said rolling bearings, as is the case with sliding bearings, since they can manage with the oil mist which is generally present under the valve cover.

As a development, a method for producing a camshaft, having the following steps, is proposed:

- producing the base shaft with continuous external splines,
- producing the sliding cam units and preliminary mounting of the latter on the base shaft,
- finish-grinding the cam contours of the cams of the sliding cam units,
- removing the sliding cam units and cleaning them and the base shaft,
- alternately mounting the sliding cam units and the complete rolling bearings, including the rings, which also serve as bearing inner rings, on the base shaft, and
- equalizing the temperatures of the components.

The rings are simply placed on the external splines of the base shaft and pushed to the appropriate location by the application of force. To make it easier to overcome the resistance between the external splines and the ring, a lubricant/ adhesive agent can be used, if appropriate, and this also ensures good seating adhesion after the rings have been positioned at the appropriate location.

As a development of the production method, it is proposed that the base shaft should be frozen before mounting the rings, causing it to shrink and thus making it easier to mount the rings.

As soon as the base shaft heats up and adjusts to the temperatures of the other components, a nonpositive joint of the rings on the base shaft with a preselected interference fit is formed.

As an alternative to the freezing of the base shaft, it is also possible for the rings to be heated. In this case, the bearings, in particular rolling bearings, should be mounted only when the rings have cooled sufficiently. The two measures can also be used in combination.

In order to improve the accuracy of the position of the cams, the sliding cam units can be mounted in the same final location and angular position on the base shaft as for finish grinding.

BRIEF DESCRIPTION OF THE DRAWINGS

To further explain the invention, attention is drawn to the drawings, in which two illustrative embodiments of the invention are shown in simplified form and in which.

DETAILED DESCRIPTION OF THE PREFERRED EMBODIMENTS

In FIGS. 1 to 4, to the extent that specific indications are given, 1 denotes in general a camshaft, which has a base shaft 2 and sliding cam units 3. The base shaft 2 has continuous external splines 4, which comprise the regions of the sliding cam units 3 including the travel thereof. Installed between the sliding cam units 3 are rings 5, which are secured nonpositively on the external splines 4.

Figure 1:
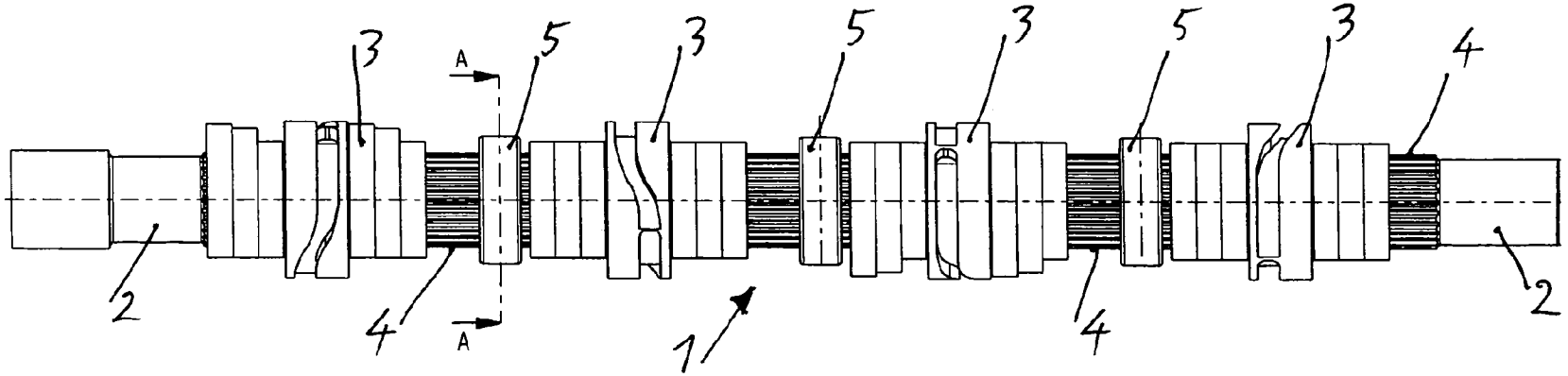
FIG. 1: shows a side view of a fully assembled camshaft.
Figure 2:
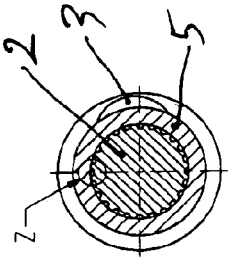
FIG. 2: shows a section through the camshaft along the line A-A in FIG. 1, FIG. 3: shows an enlarged view of detail Z in FIG. 2 according to version 1.
Figure 3:
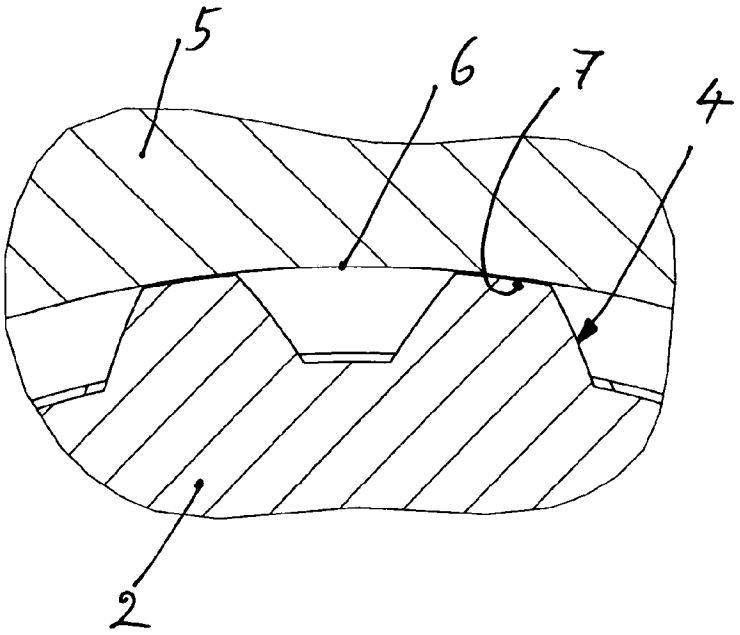

As can be seen from FIG. 3, the ring 5 has a circular-cylindrical inner circumferential surface 6, which is supported on the addendum surfaces 7 of the external splines 4 of the base shaft 2. The rings 5 are fixed nonpositively on the external splines 4 of the base shaft 2.

Figure 4:
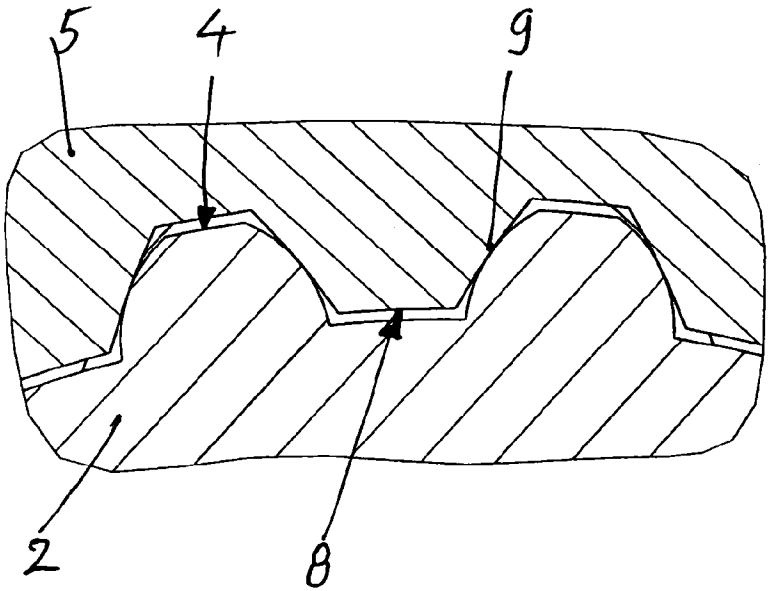
FIG. 4: shows an enlarged view of detail Z in FIG. 2 according to version 2.

In an alternative embodiment, shown in FIG. 4, the ring 5 has internal splines 8, which have trapezoidal inner flanks 9 that correspond to the involutes of the external splines 4, designed as a splined hub profile, and produce the nonpositive joint together with said involutes.

LIST OF REFERENCE SIGNS

1 camshaft
2 base shaft
3 sliding cam units
4 external splines
5 rings
6 inner circumferential surface
7 addendum surfaces
8 internal splines
9 trapezoidal inner flanks

The invention claimed is:

1. A reciprocating-piston internal combustion engine comprises a crank mechanism, at least one cylinder head, intake and exhaust ducts for the at least one cylinder head which are controlled by in each case at least one gas exchange valve designed respectively as an intake valve and an exhaust valve, said gas exchange valves are actuatable by cams on at least one camshaft and by transmission elements driven by said cams, wherein the cams comprise sliding cams with at least two cams per sliding cam unit, said sliding cams are arranged via internal splines on an externally splined base shaft that prevents relative rotation but allows axial movement, at least one device which is fixed with respect to the internal combustion engine for moving the sliding cam unit into different axial positions via sliding grooves on a circumference of the sliding cam unit which interact with an actuator pin, and bearings for fixing the base shaft radially and axially on a component of the internal combustion engine, and rings acting as supporting elements for the bearings are secured on the external splines of the base shaft.

2. The reciprocating-piston internal combustion engine as claimed in claim 1, wherein the externally splined base shaft has continuous external splines including in regions of the sliding cam units and of the rings.

3. The reciprocating-piston internal combustion engine as claimed in claim 1, wherein the base shaft has a shaft profile for rotational connection to the sliding cam units, and the rings have a circular-cylindrical inner circumferential surface, and the rings are fixed nonpositively on addendum surfaces of the shaft profile.

4. The reciprocating-piston internal combustion engine as claimed in claim 1, wherein the externally splined base shaft has a splined hub profile with involute splines for rotational connection to the sliding cam units, the rings have internal splines with trapezoidal flanks, and the rings are secured nonpositively on the splined hub profile.

5. The reciprocating-piston internal combustion engine as claimed in claim 1, wherein the rings comprise inner rings of rolling bearings.

* * * * *